United States Patent [19]

Witt et al.

[11] Patent Number: 5,047,098

[45] Date of Patent: Sep. 10, 1991

[54] LIQUID PROPELLANT

[75] Inventors: Wolfram Witt, Duesseldorf; Karlheinz Reinelt, Hermannsburg, both of Fed. Rep. of Germany

[73] Assignee: Rheinmetall GmbH, Düsseldorf, Fed. Rep. of Germany

[21] Appl. No.: 925,520

[22] Filed: Oct. 28, 1986

Related U.S. Application Data

[63] Continuation of Ser. No. 606,671, Mar. 5, 1984, abandoned.

[30] Foreign Application Priority Data

Apr. 3, 1983 [DE] Fed. Rep. of Germany ..... 33077312

[51] Int. Cl.[5] ..... C06B 25/36

[52] U.S. Cl. ..... 149/89; 89/7

[58] Field of Search ..... 149/89; 89/7

[56] References Cited

U.S. PATENT DOCUMENTS

| | | | |
|---|---|---|---|
| 2,967,099 | 1/1961 | Pool | 149/89 |
| 3,098,350 | 7/1963 | Barry et al. | 149/89 |
| 3,127,736 | 4/1964 | Bost et al. | 149/89 |
| 3,318,741 | 5/1967 | Jones | 149/89 |
| 4,292,098 | 9/1981 | Mastroianni et al. | 149/89 |
| 4,317,691 | 3/1982 | Katsuta et al. | 149/89 |

*Primary Examiner*—Edward A. Miller

*Attorney, Agent, or Firm*—Spencer & Frank

[57] ABSTRACT

A liquid propellant for use in a propellant medium combustion chamber of a gun barrel weapon. The liquid propellant is completely decomposed and its combustion velocity is adjusted to the requirements of the weapon and projectile so as to provide a preponderantly oscillation-free plateau-like gas pressure development curve. The liquid propellant consist of a monergolic or nonhypergolic liquid propellant substance which includes up to 40% by weight of additives, preferably in the form of inhibitors. As starting material there are used aliphatic compositions, preferably nitrated alcanes or nitrates of alcanes, for example, isopropylinitrate or nitromethane. As inhibitors for moderating the burning there are used alcohols, such as methylalcohol or isopropylalcohol, which are admixed to the starting material. The inhibitors and/or liquid propellant include additional additives which act as radical binders which preponderantly prevent gas pressure oscillations and effect a plateau-like gas pressure development curve.

9 Claims, 1 Drawing Sheet

LIQUID PROPELLANT

This application is a continuation of Ser. No. 06/606,671, filed Mar. 5, 1984 now abandoned.

BACKGROUND OF THE INVENTION

The invention relates to a liquid propellant for producing propellant gases in gun barrels.

There is described in co-pending and co-assigned U.S. patent application Ser. No. 06/480,686, filed Mar. 31, 1983 now U.S. Pat. No. 4,574,681, a liquid propellant medium for use in gun barrel weapons. Such gun barrel weapon effects a secure continuous operation and, when used, for example, with a monergolic liquid propellant medium, a complete propellant medium of the consumption with uniform combustion is achieved. The utilization of purely liquid propellant mediums can, however, lead even with such improved gun barrel weapons to unintentional gas pressure oscillations during the firing process. Even when such liquid propellant mediums are provided with further additive liquid propellant compositions, for example, by adding microencapsulated propellant mediums to the principal propellant medium, the afore-described gas pressure oscillations are only insignificantly mitigated.

Furthermore, it is necessary to consider that when using a liquid propellant medium within a gun barrel combustion chamber it is not possible to satisfactorily control in a definite manner an alteration of the burning surface which leads to an alteration of the burning characteristics, in particular to an alteration of the reaction velocity and thereby to an alteration of the burning time. Therefore, differing weapon and projectile-specific requirements, as can, for example, be met by solid propellant mediums by altering the powder form and proportionately altering the powder surface, can only be achieved in a limited sense with liquid propellant mediums.

SUMMARY OF THE INVENTION

It is an object of this invention to provide a liquid propellant medium for a propellant medium combustion chamber of, for example, a gun barrel weapon, by means of which in addition to a complete decomposition of the medium, a burning velocity is achieved which is accompanied with a preponderantly oscillation-free, as well as plateau-like, gas pressure development.

BRIEF DESCRIPTION OF THE DRAWING

With this and other objects in view, which will become apparent in the following detailed description, the present invention will be clearly understood in connection with the accompanying drawings, in which.

DETAILED DESCRIPTION

For definitions of the terms "monergolic" and "non-hypergolic", reference is made to pages 12–16, incl., of the *Rheinmetall Handbook on Weaponry*, 2nd English ed., copyright 1982 by Rheinmetall GmbH, Duesseldorf, published by Broenners Druckerei Breitenstein GmbH, Frankfurt am Main, West Germany.

Reference is also made to an article entitled "LIQUID PROPELLANT CHARGES FOR GUN AND MORTAR AMMUNITION" authored by Dr. Wolfram Witt and Karlheinz Reinelt, the inventors of this application, which article was published in INTERNATIONAL DEFENSE REVIEW 1/1981. Copy of this article is attached.

Figure 1:
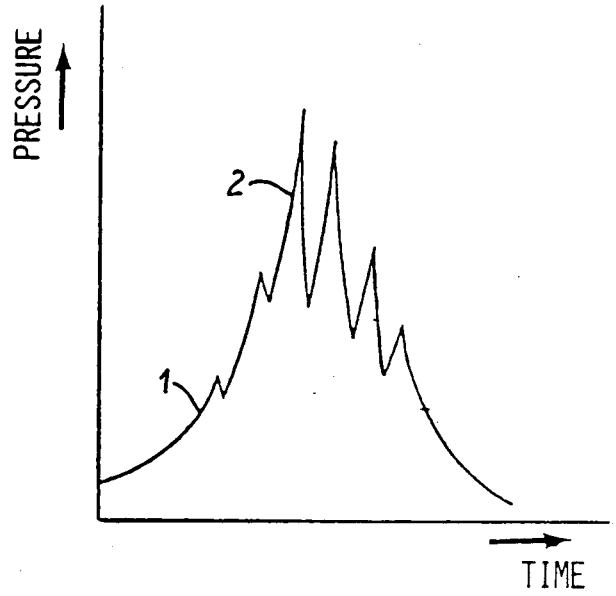
FIG. 1 is a pressure-time-diagram illustrating the gas pressure development of a purely monergolic or non-hypergolic liquid propellant medium with pronounced oscillations.

FIG. 1 illustrates a gas pressure development 1 having strong oscillations 2 of the gas pressure, as occurs with a purely monergolic or non-hypergolic liquid propellant medium, for example when used in a propellant medium combustion chamber of a gun barrel weapon of the afore-described type.

Figure 2:
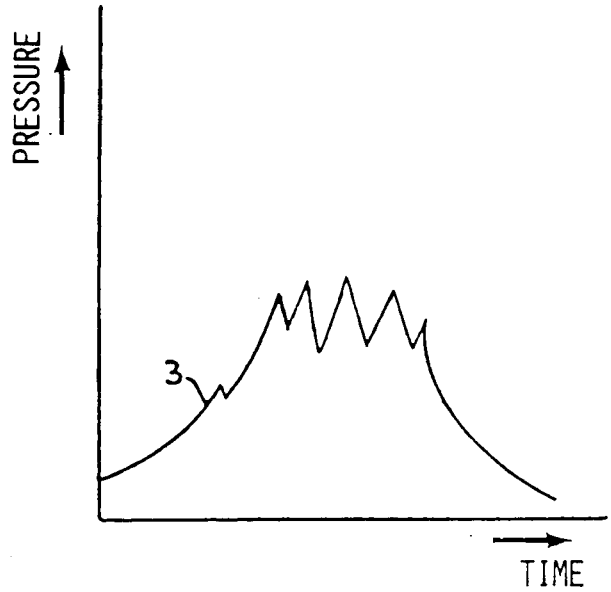
FIG. 2 is a pressure-time-diagram of a gas pressure development, reduced in height, of a monergolic or non-hypergolic liquid propellant medium which is inhibited by a burning moderator that alters the pressure level and burning time of the propellant medium.

When a monergolic or non-hypergolic liquid propellant substance is used as basic substance for the propellant medium, in particular an aliphatic compound, composed of nitrated alkanes and nitrates of the alkanes and including inhibiting additives which alter the burning characteristics, there is formed a throttled gas pressure development curve 2 at the gas pressure level as illustrated in FIG. 2. The additives make possible that the reaction velocity of the basic composition is altered, in particular is slowed. Propellant medium inhibitors are used as burning moderates for altering the reaction velocity and thereby also the pressure level and the burning time. Preferably soluble uni-valent alcohols, in particular methyl alcohol, ethyl alcohol, propyl alcohol, butyl alcohol, isopropyl alcohol, isobutyl alcohol, but also multi-valent, in particular 2-valent alcohol such as ethylene glycol are used.

Figure 3:
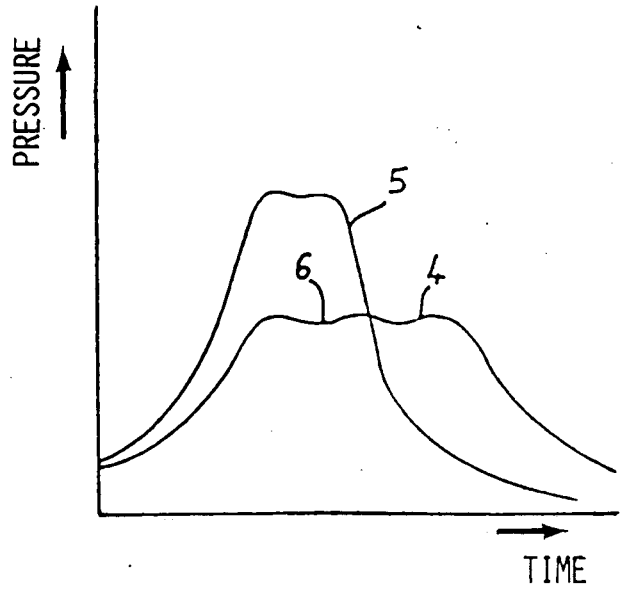
FIG. 3 is a pressure-time-diagram of two gas pressure developments, reduced in height and preponderantly oscillation free, the gas pressure development being inhibited a composition in accordance with this invention having different burning moderators and further additives, wherein the liquid propellant medium is monergolic or non-hypergolic.

There is illustrated in FIG. 3 gas pressure development curves 4, 5 which illustrate not only a throttled gas pressure level, but also a preponderantly oscillation-free gas pressure development which has no undesirable gas pressure jumps. During the gas pressure development of curve 4 a distinct and characteristic plateau can be recognized. This preponderantly oscillation-free gas pressure development is attained in that the liquid propellant medium and/or the inhibitors have gas pressure oscillation-throttling additives which act as radical-binders. In particular the additives consisting of 1,4 dihydroxybenzene, copper(II)-acetylacetonate, 4-tert.-Butyl-1,2-dihydroxybenzene, $(CH_3)_3C\text{-}C_6H_3(OH)_2$, tetrabutyltin and additives of tertiary butylperbenzoate have been found to be effective.

By varying the basic composition as starting composition for the monergolic or non-hypergolic liquid propellant medium and by admixing of inhibitors (whereby the liquid propellant medium and/or the inhibitors include oscillation-throttling additives) it is advantageously possible, to adjust the reaction velocity, which is dependent on the combustion surface, as well as the pressure elevation, respectively pressure level and the burning time to thereby attain a gas pressure development which is preponderantly free of gas pressure jumps.

When using, for example, isopropylnitrate as a starting composition for the monergolic liquid propellant medium and isopropyl alcohol as an inhibitor as well as an additive of copper(II)-acetylacetone in the propellant medium combustion chamber of a gun barrel weapon of the afore-described type, there is achieved a relatively long plateau-like gas pressure development curve 4, whereas with a starting material consisting of isopropylnitrate and nitromethane, which is inhibited by isopropyl alcohol, and includes an additives of copper(II)-acetylacetonate, the reaction velocity is shortened and the pressure plateau can correspondingly be increased as per the gas pressure development curve 5.

The liquid propellant medium reacts in a particularly performance-increasing manner when the monergolic liquid propellant substance consists of a mixture of 70–99.5 weight percent isopropylnitrate and 0.5–30 weight percent of inhibitors and when as inhibitors 0.5 to 30 weight percent of isopropyl alcohol or up to 30 weight percent of isopropyl alcohol and an additive of copper(II)-acetylacetonate are used. A similar performance-increase is achieved when using a non-hypergolic liquid propellant medium, when the liquid propellant medium consists of a mixture of 60 to 99.5 weight percent of nitromethane and 0.5 to 40 weight percent of inhibitors and when such inhibitors are made up of 0.5 to 40 weight percent of methyl alcohol or up to 40 weight percent of methyl alcohol having an additive of copper (II)-acetylacetonate.

The following firing tests demonstrate, by way of example, the performance-increase that is achieved by a liquid propellant medium in accordance with the invention.

The firings were carried out with a weapon having a 20 mm caliber and having a projectile weight of 120 grams and a combustion chamber of 75 cubic cm.

By using a purely liquid propellant medium, for example 60 grams of pure nitromethane a gas pressure of 5000 bar and a muzzle exit velocity of 920 meters/-second was achieved.

In comparison when using, for example, 70% by weight nitromethane as basic material for the liquid propellant medium, 29.5% by weight of methyl alcohol as inhibitor and an additive of 0.5% by weight copper (II)-acetylacetonate at a low weapon-sparing gas pressure of only 3000 bar there was achieved nevertheless an increased muzzle exit velocity of the projectile of 1030 meters/second.

The increase in efficiency is particularly traceable to that the inhibitors and the additives with a density of the liquid propellant medium mixture between 0.6 grams/ccm up to 1.4 grams/ccm are in a position to throttlingly influence the decomposition reaction in such a way that the gas pressure oscillations during a reproduceable firing operation are controlled and a complete propellant medium decomposition is achieved.

Above all the strong oscillations of the curve portion 2 of the gas pressure, as illustrated in the gas pressure development curve 1 of FIG. 1, are avoided by means of the inhibitors and additives, whereby in a particular advantageous manner an improved energy utilization and an increased initial velocity of the projectile is achieved and preponderantly a negative influencing of the projectile movement in the gun barrel is avoided.

The liquid propellant medium in accordance with the invention distinguishes itself further advantageously in that it is completely decomposed in a suitable propellant medium combustion chamber without leaving any residue, and that because of its very reduced toxic properties, it advantageously can be easily handled and can be made available in large quantities.

Although a limited number of embodiments of the invention have been illustrated in the accompanying drawings and described in the foregoing specification, it is to be expressly understood that various changes, such as in the relative materials used, and the like, as well as the suggested manner of use of the composition of the invention, may be made therein without departing from the spirit and scope of the invention, as will now be apparent to those skilled in the art.

We claim:

1. An improved liquid propellant for producing propellant gases in a gun barrel weapon, wherein the basic starting substance of the liquid propellant consists essentially of a monergolic or non-hypergolic liquid propellant of at least one aliphatic composition selected from the groups of nitrated alkanes which consists of nitromethane, nitroethane, nitropropane, and/or a nitrate of the alkanes of methane, ethane, and propane, and includes at least one inhibitor for adjusting the propellant gas pressure and burning time of the liquid propellant which consists of univalent alcohol selected from the group of methanol, ethanol, propanol, or ethylene glycol, the improvement comprising that said liquid propellant includes a gas-pressure-throttling additive, and said additive is selected from the group consisting of 1, 4 dihydroxybenene, copper (II)-acetylacetonate, 4-tert.-butyl-1,2-dihydroxybenzene, tetrabutyl tin and tertiary butylperbenzoate.

2. The improved liquid propellant as set forth in claim 1, wherein said monergolic liquid propellant consists of a mixture of 70%–99.5% by weight of isopropylnitrate and 0.5% to 30% by weight of inhibitor and throttling additives combined.

3. The improved liquid propellant as set forth in claim 2, wherein the inhibitor consists of 0.5% to 30% by weight of isopropylalcohol.

4. The improved liquid propellant as set forth in claim 1, wherein said non-hypergolic liquid propellant consists of a mixture of 60% to 99.5% by weight of nitromethane and 0.5% to 40% by weight of inhibitor and throttling additives combined.

5. The improved liquid propellant as set forth in claim 4, wherein the inhibitors and throttling additives combined consist of 0.5% to 40% by weight of methylalcohol and copper (II)-acetylacetonate.

6. The improved liquid propellant as set forth in claim 1, wherein said monergolic liquid propellant consists of a mixture of 60% to 99.5% by weight of isopropylnitrate and nitromethane and 0.5% to 40% by weight of inhibitors and throttling additives combined.

7. The improved liquid propellant as set forth in claim 6, wherein said monergolic liquid propellant has a density ranging from 0.6 g/cm$^3$ to 1.4 g./cm$^3$.

8. The improved liquid propellant as set forth in claim 2, wherein the inhibitor and throttling additives combined consists of up to 30% by weight of isopropylalcohol and copper (II)-acetylacetonate.

9. The improved liquid propellant as set forth in claim 5, having about 0.5% by weight of copper (II)-acetylacetonate.

* * * * *